US005247146A

United States Patent [19]

Civanelli et al.

[11] Patent Number: 5,247,146

[45] Date of Patent: Sep. 21, 1993

[54] METHOD AND DEVICE FOR DETERMINING THE WEIGHT OF FOODS CONTAINED IN A MICROWAVE OVEN AND FOR CONTROLLING THEIR TREATMENT

[75] Inventors: Claudio Civanelli, Travedona; Ivano Frattini, Leggiuno; Carlo Montanari, Milan, all of Italy

[73] Assignee: Whirlpool International B.V., Veldhoven, Netherlands

[21] Appl. No.: 647,385

[22] Filed: Jan. 29, 1991

[30] Foreign Application Priority Data

Feb. 1, 1990 [IT] Italy ..... 19214 A/90

[51] Int. Cl.[5] ..... H05B 6/68

[52] U.S. Cl. ..... 219/10.55 M; 219/10.55 E; 99/325; 426/243

[58] Field of Search ..... 219/10.55 R, 10.55 F, 219/10.55 M, 10.55 B, 10.55 E, 518, 10.55 A; 99/DIG. 14, 325; 426/524, 243

[56] References Cited

U.S. PATENT DOCUMENTS

| | | | |
|---|---|---|---|
| 3,976,961 | 8/1976 | Moore | 335/146 |
| 4,341,937 | 7/1982 | Staats | 219/10.55 M |
| 4,520,250 | 5/1985 | Ishihara et al. | 219/10.55 B |
| 4,727,799 | 3/1988 | Oshima et al. | 219/10.55 E |
| 4,871,891 | 10/1989 | Steers et al. | 219/10.55 B |
| 4,882,462 | 11/1989 | Husslein et al. | 219/10.55 B |
| 4,970,374 | 11/1990 | Ueda et al. | 219/10.55 B |
| 4,998,001 | 3/1991 | Cigarini et al. | 219/10.55 M |
| 5,036,172 | 7/1991 | Kokkeler et al. | 219/10.55 M |

*Primary Examiner*—Bruce A. Reynolds
*Assistant Examiner*—Tu Hoang
*Attorney, Agent, or Firm*—Thomas J. Roth; Stephen D. Krefman; Thomas E. Turcotte

[57] ABSTRACT

This invention provides a method and apparatus for determining the weight of foods contained in a microwave oven and for controlling their treatment in accordance with that weight. The apparatus determines the weight by measuring the heating of a body of microwave-sensitive material disposed in the chamber during a stage of operation of the magnetron at a predetermined power for a predetermined time, wherein the heating of the body disposed on a wall of the cooking chamber which is not screened by the foods is measured by comparing the variation in the electrical characteristics of components disposed external to the chamber. The electrical components are disposed in a position corresponding with the body and in a position corresponding with a part of the wall which is not associated with the body, such that ambient temperature variations in the body are compensated for by corresponding temperature variations in the wall not associated with the body.

6 Claims, 1 Drawing Sheet

METHOD AND DEVICE FOR DETERMINING THE WEIGHT OF FOODS CONTAINED IN A MICROWAVE OVEN AND FOR CONTROLLING THEIR TREATMENT

FIELD OF THE INVENTION

This invention relates to a method and device for determining the weight of foods contained in a microwave oven having a cooking chamber and a microwave generator or magnetron, for the purpose of fixing the magnetron operating power and controlling the treatment of the foods.

BACKGROUND OF THE INVENTION

In general in a microwave oven provided with a microprocessor controlling the operation of the magnetron, the food treatment (thawing, thawing plus heating, or thawing plus cooking) can be preplanned by the user by setting the food weight, the food type and the required type of treatment. These data enable the microprocessor to control the magnetron operation at the power and for the time required to obtain the desired treatment.

To determine the weight of a food contained in the microwave oven and on this basis set the operation of the magnetron and control the treatment of the food, it is known to measure the quantity of water contained in it when the food is frozen or is in any event at low temperature. This forms the subject of preceding patent applications in the name of the present applicant, which claim the use of bodies constructed of microwave-sensitive material disposed below the food in appropriate cavities provided in the oven casing. These bodies absorb the microwaves generated by the magnetron to a different extent depending on the free water contained in the food and on the temperature of this latter. The greater the quantity of free water present in the food the smaller the amount of microwaves which reach the body lying below it, and the less the body heats up.

As the percentage of water in foods is proportional to the weight of the food itself for each food type, the food weight can be determined by indirectly measuring this quantity of free water. To obtain this measurement, the bodies are associated with probes which measure their temperature and feed the measured data to the usual microprocessor which by knowing the quantity of free water present in the food, can use this information to obtain its weight, set the operation of the magnetron and control the treatment of the food.

In this respect it has been surprisingly found that the heating curve for such bodies of microwave-sensitive material becomes, within a small time period from application of the microwaves, a straight line for temperature/time, the slope of which varies according to the food weight.

It is apparent that if at the end of this time period T a measurement is made either of the slope of this straight line or the point of intersection with the temperature axis of a straight line parallel to the time axis and passing through the point which the temperature/time line has reached after the time period t, the microprocessor receives information corresponding to the food weight and, on the basis of this and taking into account the information fed in by the user regarding the food type and the required treatment, is able to fix the operating power of the magnetron and the duration and mode of the treatment. Although such a solution enables satisfactory results to be obtained, it is of complicated construction particularly with regard to the formation of the seats for the microwave-sensitive bodies or elements and the seats for the probes. In addition, as the heating of the elements depends on the degree to which the foods positioned above them are transparent to the microwaves, any mistake in positioning the foods in the cooking chamber falsifies the data received by the microprocessor and thus falsifies its action on the magnetron and its control over the food treatment. In addition, once the microwave-sensitive elements have become hot it is not possible to reuse them for determining the weight of another food to be treated until they have cooled down, otherwise the weight determination is inaccurate. Finally, the use of probes to measure the temperature of the microwave-sensitive bodies increases the oven construction costs.

SUMMARY OF THE INVENTION

An object of the present invention is therefore to provide a microwave oven and a method by which the weight of a food to be treated can be determined, to thus enable the control of food treatment to be improved compared with that obtainable in ovens of the known art.

A further object is to provide an oven of the aforesaid type in which the magnetron and food treatment control can be effected in a simpler manner and at lower capital cost than the methods used in known ovens.

A further object is to provide a microwave oven in which the magnetron and food treatment control is effected in an efficient, safe and reliable manner, and in which this control can be effected during successive periods of oven operation without having to wait for the microwave-sensitive element to cool. These and further objects are attained by a method for determining the weight foods contained in a microwave oven and for controlling their treatment, the oven comprising a cooking chamber and a microwave generator or magnetron, the determination being made by measuring the heating of a body of microwave-sensitive material disposed in the chamber, during a stage of operation of the magnetron at a predetermined power for a predetermined time, characterised in that the heating of the body, disposed on a wall of the cooking chamber which is not screened by the foods, is measured by comparing the variation in the electrical characteristics of components disposed external to the chamber in a position corresponding with the body and in a position corresponding with a part of the wall which is not associated with the body respectively.

The method is implemented by a device characterised by comprising a body constructed of microwave-sensitive material disposed, in a position not screened by the food, at any point on a wall of the cooking chamber, and electrical components of temperature-variable characteristics disposed external to the chamber in a position corresponding with the body and in a position corresponding with a part of the wall which is not associated with the body respectively.

The present invention will be more apparent from the accompanying drawing, which is provided by way of non-limiting example and in which:

DETAILED DESCRIPTION OF PREFERRED EMBODIMENTS

Figure 1:
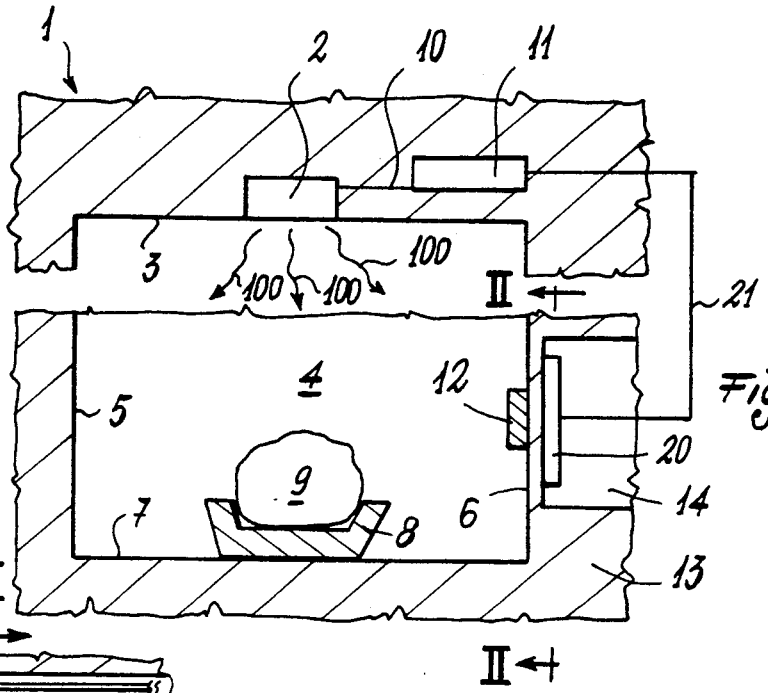
FIG. 1 is a partial schematic cross-section through a microwave oven constructed in accordance with the invention.

With reference to the figures, a microwave oven indicated overall by 1 comprises a microwave generator or magnetron 2 disposed in the roof 3 of a cooking chamber 4 having side walls 5 and 6 and a bottom wall or base 7.

A support plate 8, for example of ceramic, terracotta or the like for a food 9, rests on the base 7. The magnetron 2 is operated via an electric line 10 by a usual microprocessor circuit 11 which, via said line, varies the power of the microwave generator as required.

According to the invention, on any wall (in the example the side wall 6) of the cooking chamber 4 there is positioned a body 12 of known microwave-sensitive material. Advantageously the body is formed by depositing a layer of microwave-sensitive coating of suitable thickness on the wall 6. Within the structure 13 of the oven 1 in a position corresponding with the layer of coating (known hereinafter for simplicity as the body) 12 there is provided a cavity 14, on that wall 15 of this cavity which faces away from the wall 6 there being positioned electrical resistors 16 and 17. Specifically, the resistor 16 is disposed on the wall 15 in a position corresponding with the body 12 present on the wall 6, whereas the resistor 17 is disposed in a position corresponding with a region of the wall 6 which is not associated with the body.

The thickness 18 of the metal between the surfaces or walls 6 and 15 also acts as a shield against the microwaves for the resistors 16 and 17, so offering further protection to these latter against the microwaves (which could falsify their operating characteristics).

The resistors 16 and 17 are included in an electrical circuit 20 connected to the microprocessor 11 by a line 21. The circuit 20 (not shown in detail for simplicity) is of known configuration for measuring the variation in resistivity of the resistors as a result of the heating of the body 12 and of the wall 6 of the chamber 4 on which the body is positioned, i.e. the variation in their electrical characteristics. One embodiment of the circuit 20 is represented for example by a known Wheatstone bridge in which two resistors of constant known value are connected to the resistors 16 and 17 and in which the electrical parameters (current and voltage) are of known value, thus allowing the microprocessor to determine the deviation in the characteristics of the resistors 16 and 17 from their constant or reference values as a result of the action of the magnetron 2, i.e. during the operation of the oven 1. In this respect it is well known that the resistivity of a resistor varies with temperature. On this basis, by measuring the deviation of the value from the reference value during the treatment of a food, the microprocessor is able to determine the weight of a food and its degree of heating, i.e. it can control its treatment. This is described in greater detail hereinafter.

In this respect, the method of the invention will now be described within the context of the description of operation of the oven shown in FIG. 1. It will be assumed that the food 9, for example meat, positioned on the plate 8 is to be thawed and cooked. To achieve this the magnetron 2 is initially switched on in known manner by the user, for example by means of a pushbutton positioned on the face of the oven 1. The user then sets the type of food (in this case meat) and the type of treatment (thawing and cooking). Operating the pushbutton causes the microprocessor 11 to operate the magnetron 2 at a certain constant power (for example half power) known hereinafter as the test power, for a short time period t, for example 10–15 seconds, known hereinafter as the test period. On operating the magnetron 2 only a fraction of the microwaves 100 are absorbed by the frozen food, whereas most are absorbed by the body 12, which consequently heats up.

It will be assumed that at the same time the circuit 20 and specifically the resistors 16 and 17 are powered. Following this, the microprocessor 11 measures determined resistivity values for the resistors during this stage. With the heating of the body 12, heat is transferred by conduction to the resistor 16, so varying its electrical characteristics. However the wall 6 of the cooking chamber 4 does not heat up (or heats up only to a negligible extent) because the food 9 at this stage releases only a minimum quantity of energy as it is still mostly frozen. Thus the resistivity of the resistor 17 does not vary.

In this manner, and until the food 9 has thawed (after which it releases steam which deposits on the walls of the cooking chamber 4 and heats them), the microprocessor 11 measures the varying resistivity of the resistor 16 by virtue of the particular known configuration of the circuit 20, and from this measurement and on the basis of a preset program calculates the rate at which the body 12 heats up and thus the weight of the food 9.

Figure 2:
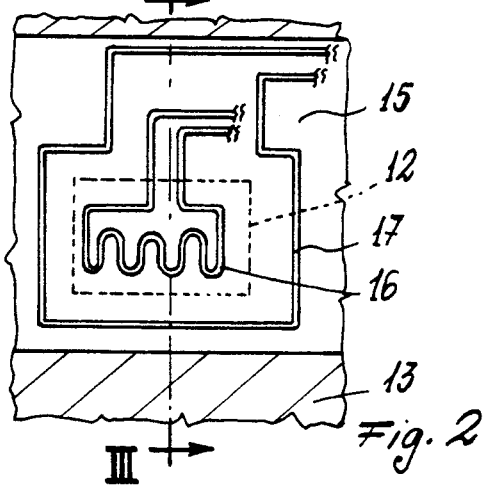
FIG. 2 is a section on the line II—II of FIG. 1.
Figure 3:
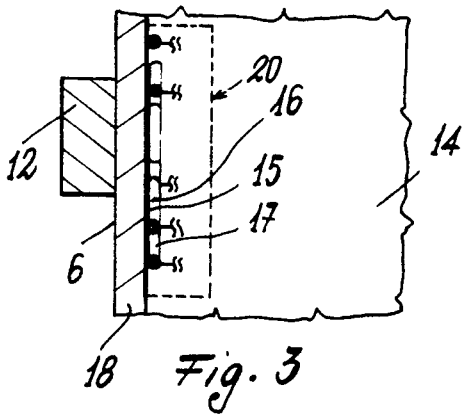
FIG. 3 is a schematic section on the line III—III of FIG. 2.
Figure 4:
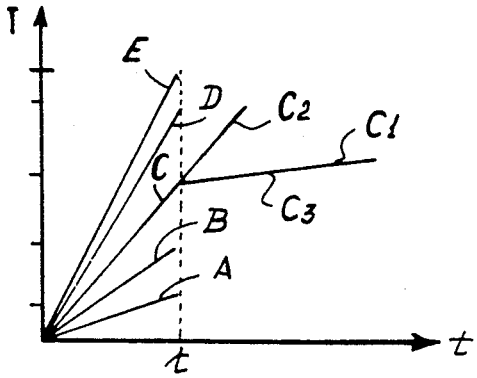
FIG. 4 is a time-temperature curve showing the variation in temperature of a microwave-sensitive body used in the oven according to the invention, during the presence of foods of different weight or of different foods of equal weight.

In this respect, it has been surprisingly discovered experimentally that the rate at which the temperature of the body 12 varies is related to the weight of the food contained in the cooking chamber 4 of the oven 1. This relationship between the weight of the food 9 and the rate of heating of the body 12 is shown in FIG. 4 by the various curves or straight lines present in this figure and their different slopes, these slopes representing the rate of heating of the body 12; the relationship is alternatively defined by the different points of intersection with the temperature axis of a straight line parallel to the time axis which passes through the points on said curves at the end of the test period t. Groups of straight lines similar to those of FIG. 2 are also obtained for the same food but of varying weight.

As stated, these curves (or data relating to the rate of heating of the body 12) were obtained experimentally by subjecting the body to the microwaves generated by a magnetron operating at the test power for a time equal to said test period. The data were obtained by positioning the body 12 in a microwave oven in the presence of frozen foods of different weight and type (such as meat, fish, vegetables, pulses and cereals).

Thus, depending on the weight of the food 9, the body 12 heats up in accordance with one of the curves A, B, C, D or E.

Following this the microprocessor 16 also attains a different temperature during the test period t, and its electrical characteristics (in particular its resistivity) will vary to a greater or lesser degree. On the basis of this the microprocessor 11 is able to calculate from known formulas the heat transferred to the resistor and consequently the energy absorbed by the body 12. The microprocessor thus obtains the weight of the food 9. Based on the evaluation of the weight of the food 9 and the data fed to the microprocessor by the user regarding the type of food and the type of treatment chosen, the microprocessor sets and controls the operation of the magnetron 2 to enable the food 9 to be treated as desired by the user.

Specifically, the parameters on which the microprocessor operates are the magnetron operating power, the duration of treatment and the power applied during this type of treatment, which can be constant or variable according to suitable criteria in optimising the cooking result.

During the stage, the microwaves continue to strike the food 9 and gradually thaw it; as thawing continues, the food 9 increasingly absorbs more microwaves, which are therefore no longer absorbed with the same intensity by the body 12. When thawing is complete, most of the microwaves 100 are absorbed by the food 9, and consequently the temperature of the body 12 increases in time at a rate less than that during the initial thawing stages (for example the portion C1 of the straight line C of FIG. 4).

The resistor 16 is exposed to all the temperature variations of the body 12, with the result that its resistivity varies to a greater or lesser degree, this variation being measured by the microprocessor 11. In particular, when the temperature gradient of the body 12 changes after the food has thawed (point C2 of FIG. 4), the microprocessor 11 detects the different increase in the resistivity and, in accordance with a preset program, acts on the magnetron 2 to halt its operation.

In reality the microprocessor 11 does not act at the precise moment in which the temperature gradient of the body 12 varies, i.e. at the point C2 of FIG. 4 (i.e. at the point of variation of the resistivity increase) but somewhat later at a higher temperature (for example at the point C3 of FIG. 4). In this manner the microprocessor 11 is therefore both able to determine the weight of the food and to measure its degree of treatment.

If desired, the oven 1 can be used for treating another food after the described treatment of the food 9, without having to wait for the body 12 to cool in order for it to be used for determining the weight of the food. In this respect, after the treatment the walls 5, 6 and 7 of the cooking chamber 4 are hot. This is detected by the microprocessor 11, the resistivity of which has now changed because of this heating. On the basis of this resistivity as measured by the microprocessor 11 (the measurement being made in a manner similar to that described for the microprocessor 16), this latter is able to calculate the temperature in the oven 1. This temperature is used by the microprocessor as the reference value for the calculation of the heating of the body 12 and hence for the calculation of the weight of the food in the oven.

Thus on reusing the oven 1, the body heats up as heretofore described. For the aforesaid reasons and in the indicated manner the microprocessor 11 calculates this heating from the increase in resistivity of the resistor 16. From this latter information and by comparing the temperature calculated on the basis of this resistivity increase with the temperature calculated on the basis of the resistivity increase of the resistor 17, the microprocessor is able to calculate the rate of heating of the body 12 and thus, in the aforesaid manner, the weight of the food in the chamber 4.

An embodiment of the invention has been described in which the electrical components used to measure the heating of the body of microwave-sensitive material are electrical resistors. However other components can be used for this purpose, such as capacitors, inductors, semiconductors or similar means, the electrical characteristics of which vary with their temperature. Such embodiments, which differ from that heretofore described, obviously also fall within the scope of the present invention.

The present invention enables the oven to be used repeatedly without any waiting, for treating different foods with control of the magnetron power and of the treatment itself by the microprocessor circuit on the basis of the weight of each food placed in the cooking chamber 4. This control is always accurate for each treatment and is not influenced by the conditions of the treatment which has previously been carried out.

The method offered by the invention is very practical. In addition the device of the invention is simpler and cheaper to construct than analogous devices of the state of the art, and in addition gives excellent results with high reliability.

We claim:

1. A method for determining a weight for foods contained in a microwave oven and for controlling their treatment based on said weight, said oven comprising a cooking chamber and a microwave generator capable of operating to generate microwave energy for heating said food, said determining a weight being made by measuring a change of heat in a body of microwave-sensitive material disposed internally on a side wall in said cooking chamber, during a stage of operation of said microwave generator at a predetermined power for a predetermined time, characterized in that said change of heat in said body, which is not screened by the foods, is monitored by resistors having variable electrical characteristics in which each provide a variation corresponding to said change of heat in said body and is measured by comparing said variation in said electrical characteristics of said resistors, said resistors disposed external to said chamber in a position corresponding with said body and in a position corresponding with a part of said wall which is not associated with said body respectively.

2. A method as claimed in claim 1, characterised in that the variation in the electrical characteristics of one of the resistors is used to define a reference value with which to compare the variation in the characteristics of the other resistor for enabling the weight of foods placed successively in the oven to be determined and their treatment to be controlled.

3. A device for controlling a treatment of foods contained in a microwave oven based on determining a weight for said foods comprising a body constructed of microwave-sensitive material disposed inside, in a position not screened by the foods, on a side wall of a cooking chamber, and resistors of temperature-variable characteristics disposed external to said chamber in a position corresponding with said body and in a position corresponding with a part of said side wall which is not associated with said body respectively.

4. A device as claimed in claim 3, characterised in that the resistors are disposed on a wall of a cavity provided within the oven, said cavity being provided in a position corresponding with said side wall of said cooking chamber on which said body of microwave-sensitive material is disposed.

5. A device as claimed in claim 3, characterised in that said body of microwave-sensitive material is formed by depositing on said side wall of said cooking chamber a layer of microwave-sensitive coating of suitable thickness.

6. A device as claimed in claim 3, characterised in that the resistors are incorporated into an electrical circuit connected to a microprocessor circuit which controls the operation of the microwave generator, said electrical circuit being in a configuration which enables the microprocessor to measure the variation in the electrical characteristics of said resistors.

* * * * *